US009142905B2

(12) United States Patent
Yu et al.

(10) Patent No.: US 9,142,905 B2
(45) Date of Patent: Sep. 22, 2015

(54) RECEPTACLE CONNECTOR WITH HIGH RETENTION FORCE

(71) Applicant: ALLTOP ELECTRONICS (SUZHOU) LTD., Taicang, JiangSu Province (CN)

(72) Inventors: Wang-I Yu, Jhonghe (TW); Hung-Chi Tai, Taicang (CN); I-Hung Cheng, Jhonghe (TW); Shi-Ke Xie, Taicang (CN)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 8 days.

(21) Appl. No.: 14/090,016

(22) Filed: Nov. 26, 2013

(65) Prior Publication Data

US 2015/0056848 A1 Feb. 26, 2015

(51) Int. Cl.

| | |
|---|---|
| ***H01R 13/516*** | (2006.01) |
| ***H01R 13/436*** | (2006.01) |
| *H01R 12/71* | (2011.01) |
| *H01R 13/41* | (2006.01) |
| *H01R 13/506* | (2006.01) |
| *H01R 107/00* | (2006.01) |

(52) U.S. Cl.

CPC ..... *H01R 13/4367* (2013.01); *H01R 12/716* (2013.01); *H01R 13/41* (2013.01); *H01R 13/506* (2013.01); *H01R 2107/00* (2013.01)

(58) Field of Classification Search

CPC .... H01R 12/716; H01R 12/724; H01R 12/57; H01R 12/7005; H01R 12/7029; H01R 23/7073; H01R 12/721; H01R 12/712; H01R 13/516

USPC ..... 439/78, 79, 485, 692

See application file for complete search history.

(56) References Cited

U.S. PATENT DOCUMENTS

| | | | | |
|---|---|---|---|---|
| 4,857,017 | A * | 8/1989 | Erk | 439/78 |
| 4,923,405 | A * | 5/1990 | Munsterman et al. | 439/78 |
| 5,249,974 | A * | 10/1993 | Wang | 439/79 |
| 5,453,016 | A * | 9/1995 | Clark et al. | 439/79 |
| 5,580,280 | A * | 12/1996 | Minich et al. | 439/620.22 |
| 5,709,556 | A * | 1/1998 | Tan et al. | 439/79 |
| 5,971,774 | A * | 10/1999 | Kuki et al. | 439/79 |
| 5,980,271 | A * | 11/1999 | MacDougall et al. | 439/78 |
| 6,106,335 | A * | 8/2000 | Merchant et al. | 439/620.23 |
| 6,655,979 | B1 * | 12/2003 | Lee | 439/357 |
| 7,537,465 | B2 * | 5/2009 | Fang et al. | 439/79 |
| 8,408,923 | B2 * | 4/2013 | Tay et al. | 439/79 |
| 2009/0269980 | A1 * | 10/2009 | Gong et al. | 439/638 |
| 2011/0281468 | A1 * | 11/2011 | Yu et al. | 439/660 |

* cited by examiner

*Primary Examiner* — Briggitte R Hammond

(74) *Attorney, Agent, or Firm* — Sughrue Mion, PLLC

(57) ABSTRACT

A receptacle connector includes an insulative housing, a number of conductive contacts, and a retainer seat. The insulative housing includes a mating face for mating with a plug connector and a mounting face opposite to the mating face. The insulative housing defines a number of contact-receiving passages penetrating from the mating face to the mounting face and a mounting recess recessed from the mounting face toward the mating face a certain distance. The conductive contacts are respectively received in the contact-receiving passages. Each conductive contact includes a contacting portion for electrically contacting the plug connector, a termination portion for electrically connecting with a Printed Circuit Board, and an intermediate portion connecting the contacting portion with the termination portion. The retainer seat is fixedly received in the mounting recess of the insulative housing.

8 Claims, 7 Drawing Sheets

RECEPTACLE CONNECTOR WITH HIGH RETENTION FORCE

BACKGROUND OF THE INVENTION

1. Field of the Invention

The present invention relates to an electrical connector, more particularly to a receptacle connector mounted on a Printed Circuit Board.

2. Description of Related Art

With the rapid development of electronic technology, electrical connectors are widely used in electric products for exchanging information, data etc. with periphery devices. An electrical connector generally comprises an insulative housing and a plurality of conductive contacts received in the insulative housing. Solder feet of the conductive contacts extend beyond the insulative housing for being soldered to a Printed Circuit Board (PCB).

To satisfy the requirements of stable signal transmission, and high transmission efficiency of the electric products, it is necessary to assure high mating stability of the electrical connectors. However, the retention force between receptacle contacts and a receptacle housing of a conventional receptacle connector is not strong enough. Hence, when the receptacle connector mates with a corresponding plug connector, if unplug force is relative high from the plug connector, the receptacle contacts of the receptacle connector are prone to being pulled to escape from the receptacle housing, further influencing the signal transmission.

Hence, it is necessary to improve the conventional receptacle connector to address problems mentioned above.

BRIEF SUMMARY OF THE INVENTION

Accordingly, an object of the present invention is to provide a receptacle connector which provides high retention force.

In order to achieve the above-mentioned object, a receptacle connector in accordance with the present invention for being mounted to a Printed Circuit Board (PCB) and mating with a plug connector, comprises an insulative housing, a plurality of conductive contacts, and a retainer seat. The insulative housing comprises a mating face for mating with the plug connector and a mounting face opposite to the mating face. The insulative housing defines a plurality of contact-receiving passages penetrating from the mating face to the mounting face and a mounting recess recessed from the mounting face toward the mating face a certain distance. The conductive contacts are respectively received in the contact-receiving passages. Each conductive contact comprises a contacting portion for electrically contacting the plug connector, a termination portion for electrically connecting with the Printed Circuit Board, and an intermediate portion connecting the contacting portion with the termination portion. The retainer seat is fixedly received in the mounting recess of the insulative housing.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
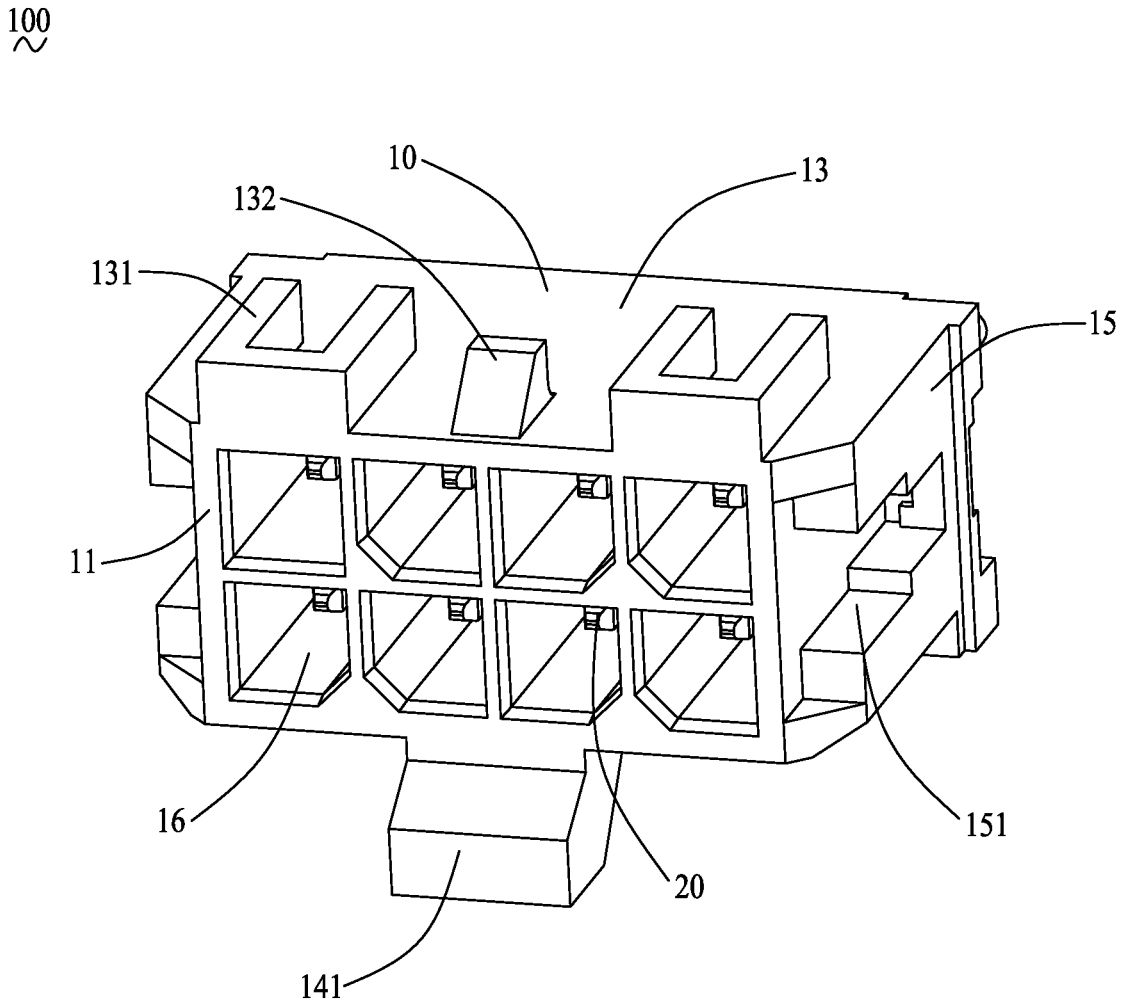
FIG. 1 is an assembled, perspective view of a receptacle connector in accordance with the present invention.
Figure 2:
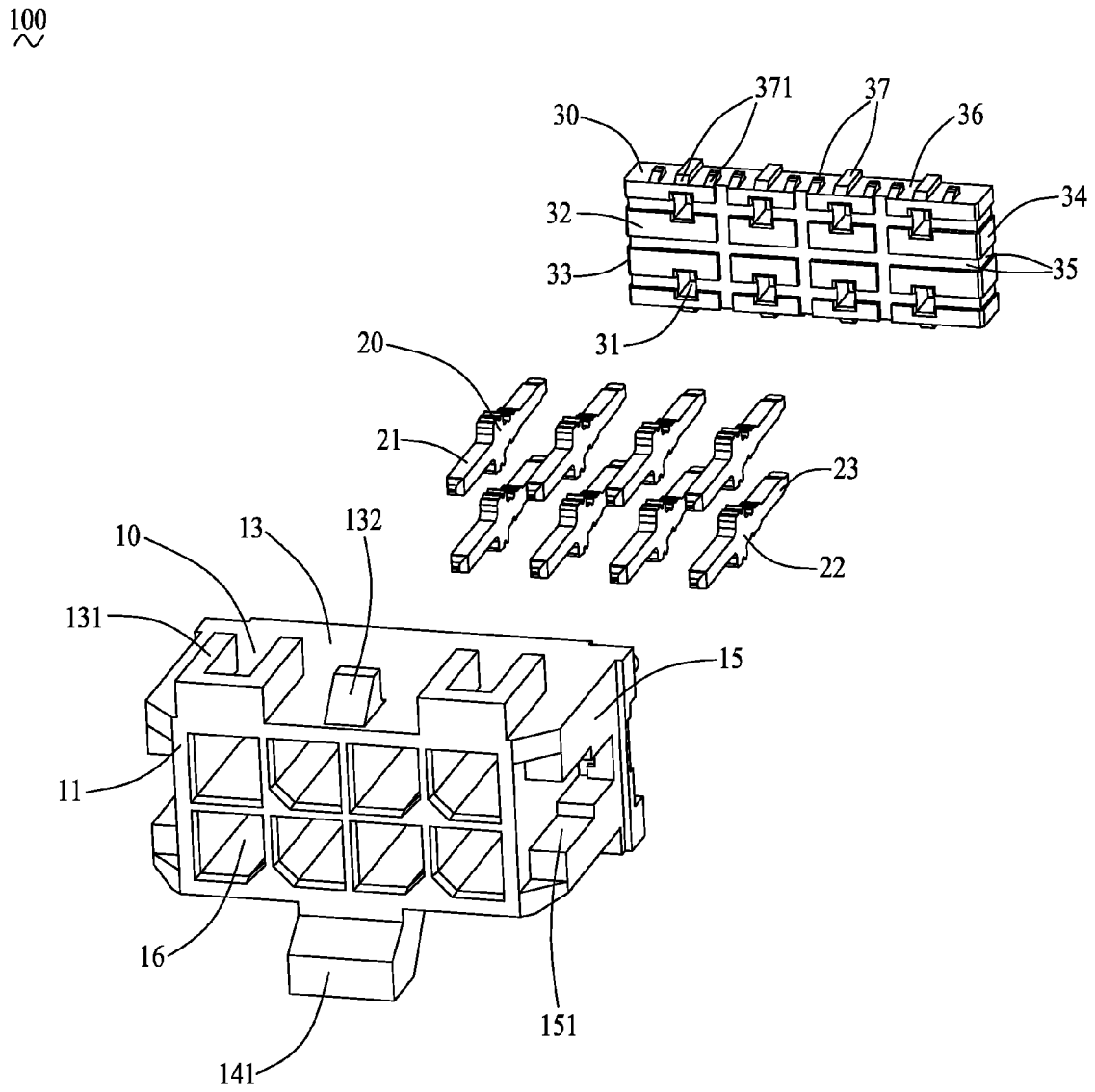
FIG. 2 is an exploded, perspective view of the receptacle connector.
Figure 3:
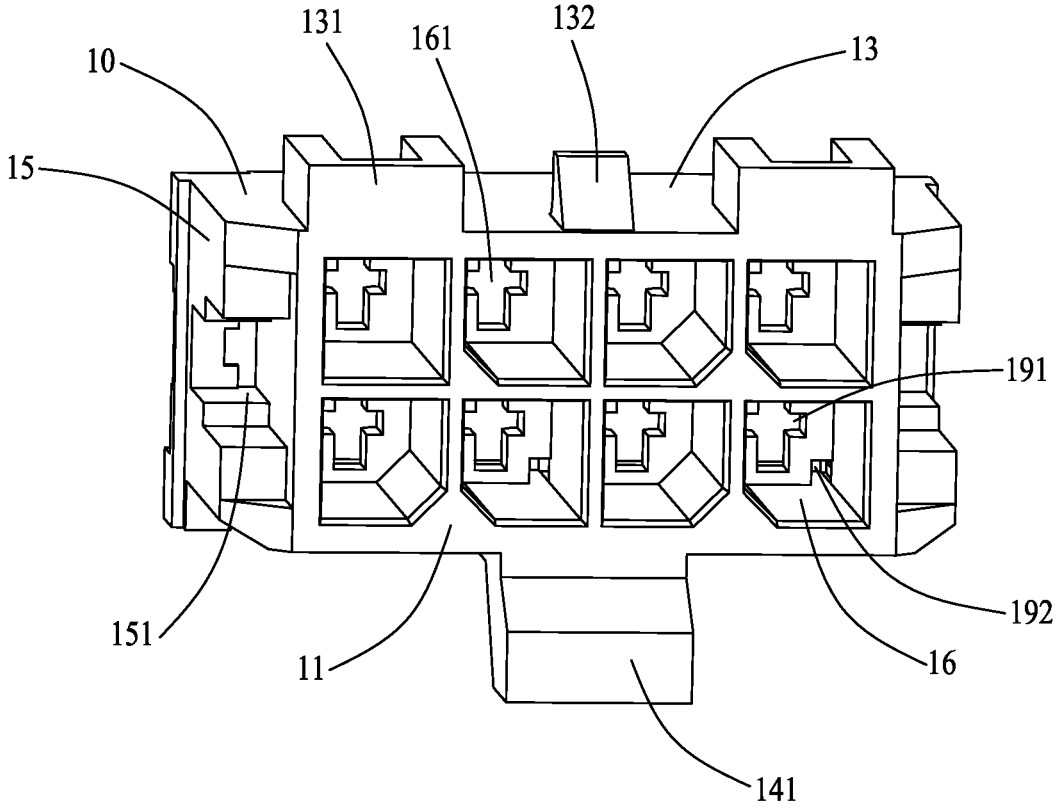
FIG. 3 is a perspective view of an insulative housing shown in FIG. 2.
Figure 4:
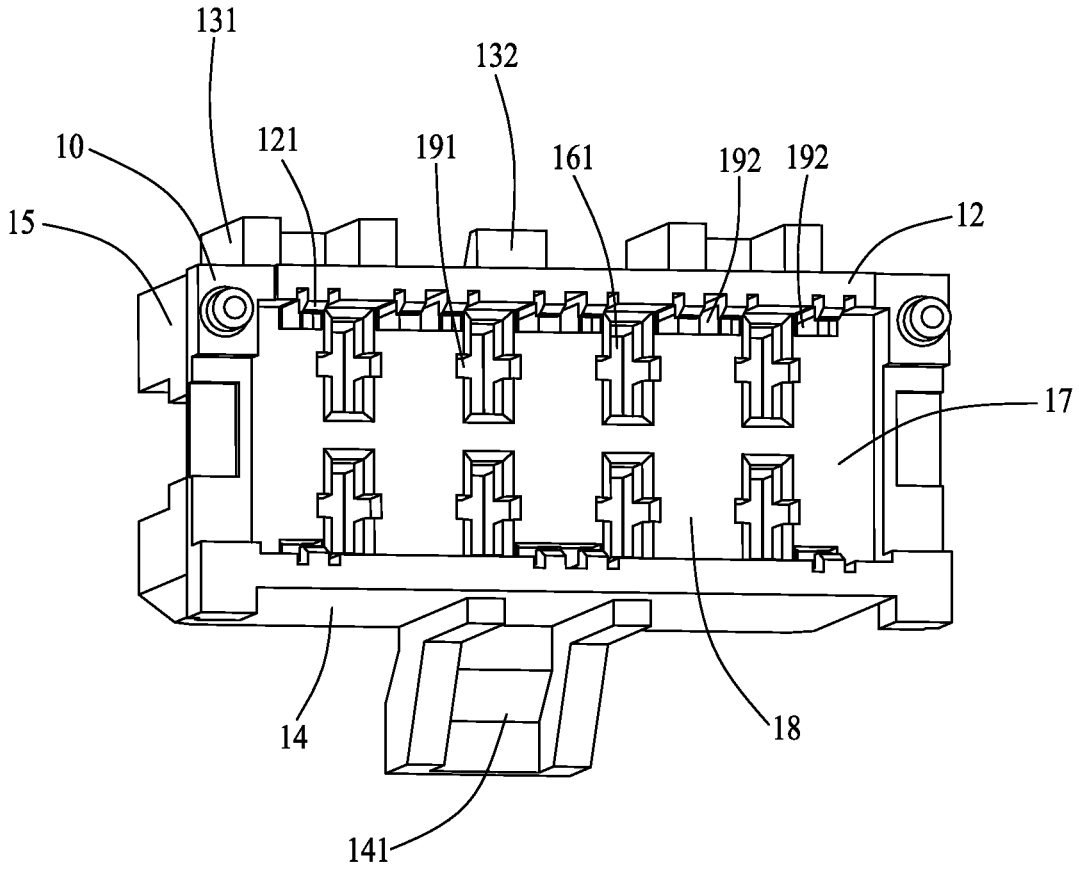
FIG. 4 is a view similar to FIG. 3, but from a different aspect.
Figure 5:
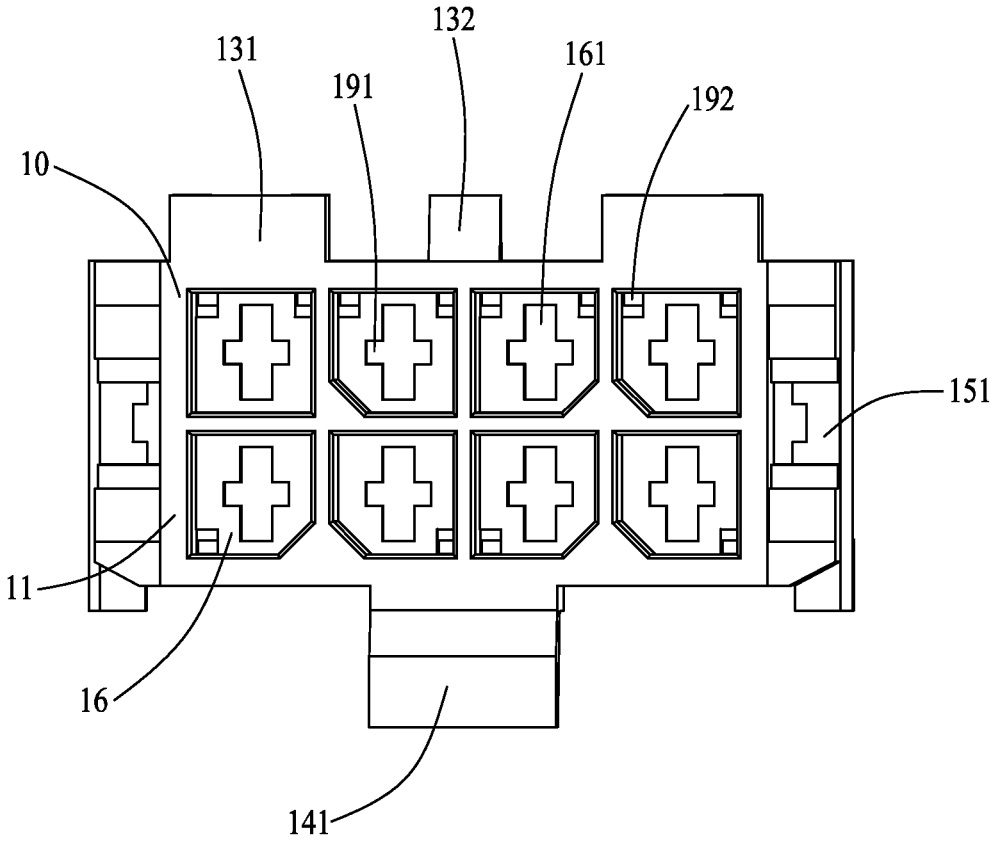
FIG. 5 is a front view of the insulative housing shown in FIG. 3.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Please refer to FIG. 1, a receptacle connector 100 in accordance with the present invention is used to be mounted on a Printed Circuit Board (not shown) to cooperate with a corresponding plug connector (not shown). The receptacle connector 100 comprises an insulative housing 10 and a plurality of conductive contacts 20 accommodated in the insulative housing 10.

Please refer to FIGS. 2-5, the insulative housing 10 comprises a front mating face 11 for mating with the plug connector, a rear mounting face 12 opposite to the mating face 11. The insulative housing 10 also comprises a top wall 13, a bottom wall 14 opposite to the top wall 13, and a pair of lateral walls 15 connecting the top wall 13 with the bottom wall 14.

The insulative housing 10 defines a plurality of contact-receiving passages 16 penetrating from the mating face 11 to the mounting face 12 to accommodate the conductive contacts 20. The contact-receiving passages 16 are arranged into two rows along an up-to-down direction. A mounting recess 17 recesses forwardly from the mounting face 12 toward the mating face 11 a certain distance and leaves a relatively thinner partition wall 18 on a rear section of the insulative housing 10. The contact-receiving passages 16 communicate with the mounting recess 17 in the form of a plurality of openings 161.

For radiating heat generated by the conductive contacts 20 when mating with the plug connector, a plurality of first heat-radiating slots 191 are defined through the partition wall 18 and communicate with the openings 161, respectively. The first heat-radiating slot 191 is transversely arranged to be perpendicular to the opening 161 to form a cross-shape together with the opening 161. A plurality of second heat-radiating slots 192 are defined through the partition wall 18 and located above and below the two rows of contact-receiving passages 16. The second heat-radiating slots 192 communicate with corresponding contact-receiving passages 16 respectively. Thus, the heat generated by the conductive contacts 20 could be radiated out of the receptacle connector 100 through the first and second heat-radiating slots 191, 192.

A plurality of latch arms 121 bends from upper and lower edges of the mounting face 12 toward the partition wall 18. A pair of first protrusions 131 and a middle second protrusion 132 protrude upwardly from the top wall 13 with the second protrusion 132 located between the pair of first protrusions 131. The cross-section view of each first protrusion 131 is U-shape and opening toward the direction directing to the mounting face 12.

A third protrusion 141 extends downwardly from the bottom wall 14. The cross-section view of the third protrusion 141 is also of U-shape opening toward the mounting face 12 and extends beyond the mating face 11.

Each lateral wall 15 is recessed with a latch groove 151 opening to communicate with the mating face 11. In the height direction of the insulative housing 10, the height of the latch groove 151 is increased gradually from the mounting face 12 toward the mating face 11, thus, the latch groove 151 is of a tower-shape. Hence, via the engagement between the first protrusions 131, the second protrusion 132, the third protrusion 141 and the latch groove 151 and the plug connector, the receptacle connector 100 and the plug connector could be mated together reliably.

Figure 6:
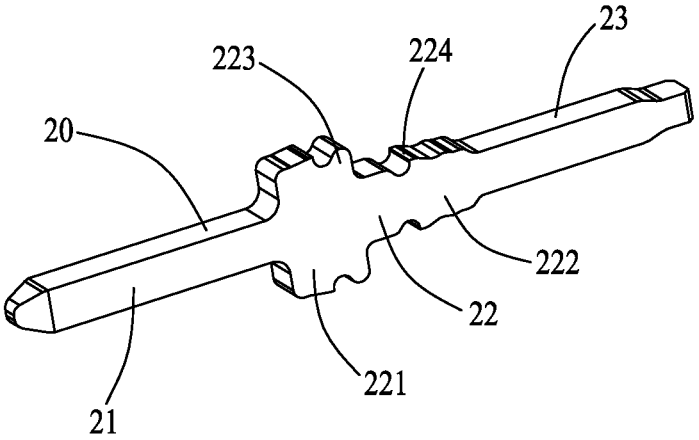
FIG. 6 is a perspective view of a conductive contact shown in FIG. 2.

Please refer to FIG. 6 in conjunction with FIGS. 2-5, the conductive contacts 20 are respectively received in the contact-receiving passages 16. Each conductive contact 20 comprises a contacting portion 21 electrically connecting with the plug connector, a termination portion 23 electrically connecting with a Printed Circuit Board (PCB) and an intermediate portion 22 connecting the contacting portion 21 with the termination portion 23.

The contacting portion 21 and the termination portion 23 both are flat. The contacting portion 21 is received in the contact-receiving passage 16, while the termination portion 23 extends beyond the insulative housing 10 for being soldered to the Printed Circuit Board.

The intermediate portion 22 comprises a front intermediate section 221 connecting with the contacting portion 21, and a rear intermediate section 222 connecting with the termination portion 23. The front intermediate section 221 is received in the opening 161 and interferentially engages with inner walls of the opening 161. The front intermediate section 221 forms a pair of protruding peaks 223 in a rear section thereof. The rear intermediate section 222 forms a plurality of barbs 224 on upper and lower edges thereof.

Figure 7:
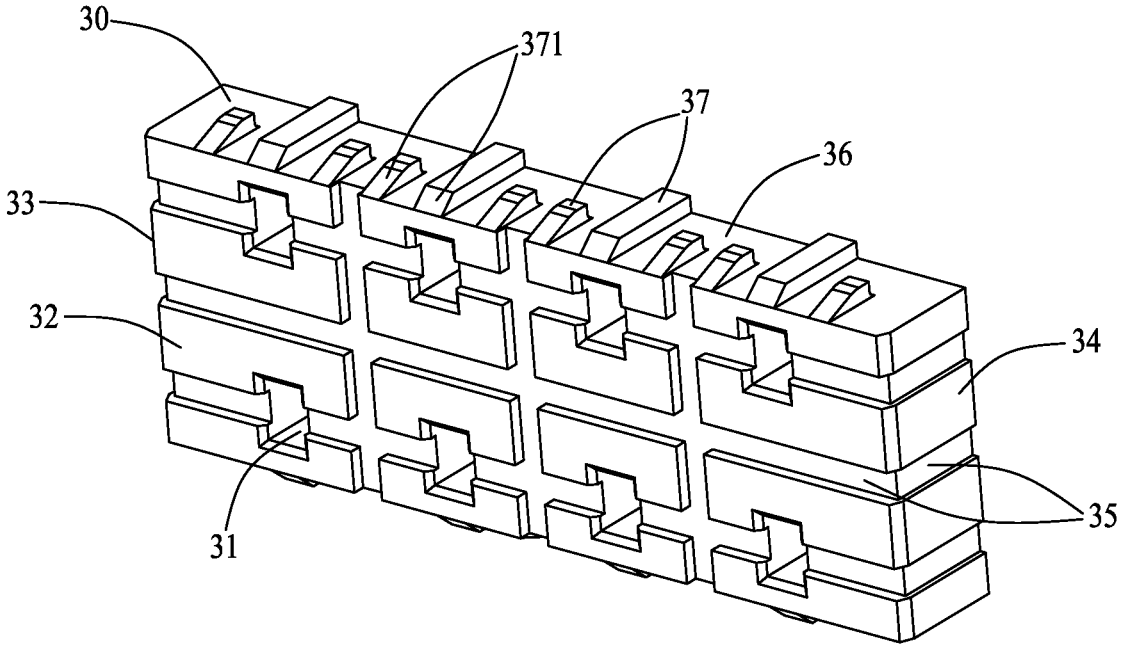
FIG. 7 is a perspective view of a retainer seat shown in FIG. 2.

Please refer to FIG. 7 in conjunction with FIGS. 2-6, the receptacle connector 100 further comprises a retainer seat 30 fixedly received in the mounting recess 17. The retainer seat 30 defines a plurality of through holes 31 aligning with and communicating with the contact-receiving passages 16.

The barbs 224 of the rear intermediate sections 222 of the intermediate portions 22 of the conductive contacts 20 interferentially engage with the through hole 31 to fix the retainer seat 30 and the conductive contacts 20. The protruding peaks 223 are received in the openings 161 respectively and one side thereof abutting against a front surface 32 of the retainer seat 30, thus, when a force is applied to the insulative housing 10 to separate the insulative housing 10 from the conductive contacts 20, the front surface 32 of the retainer seat 30 is stopped by the protruding leaks 223.

A plurality of cutouts 35 is recessed inwardly from the front surface 32, a left side surface 33 and a right side surface 34 of the retainer seat 30. The first and second heat-radiating slots 191, 192 and the cutouts 35 together form a plurality of channels for airflow. Thus, the heat generated by the conductive contacts 20 in the contact-receiving passages 16 during mating could be radiated out through the channels.

A plurality of bosses 37 are formed on an upper surface 36 of the retainer seat 30 and extend rearward. Each boss 37 forms an inclined surface 371 connecting with the front surface 32. Thus, when the retainer seat 30 is inserted to be received in the mounting recess 17, the inclined surfaces 371 engage with the latch arms 121 respectively to fix the retainer seat 30 to the insulative housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. A receptacle connector adapted for being mounted to a Printed Circuit Board (PCB) and mating with a plug connector, comprising:

an insulative housing comprising a mating face adapted for mating with the plug connector and a mounting face opposite to the mating face, the insulative housing defining a plurality of contact-receiving passages penetrating from the mating face to the mounting face and a mounting recess recessed from the mounting face toward the mating face a certain distance;

a plurality of conductive contacts respectively received in the contact-receiving passages, each conductive contact comprising a contacting portion adapted for electrically contacting the plug connector, a termination portion adapted for electrically connecting with the Printed Circuit Board, and an intermediate portion connecting the contacting portion with the termination portion; and a retainer seat fixedly received in the mounting recess of the insulative housing;

wherein the retainer seat defines a plurality of through holes aligning with and communicating with the contact-receiving passages respectively; wherein the intermediate portion of each conductive contact comprises a front intermediate section and a rear intermediate section; wherein the mounting recess is recessed from the mounting face toward the mating face to form a thinner partition wall, and wherein the partition wall defines a plurality of openings respectively communicating with the contact-receiving passages.

2. The receptacle connector as claimed in claim 1, wherein the rear intermediate section is formed with a plurality of barbs interferentially engaging with inner walls of the through holes of the retainer seat to fix the retainer seat with the conductive contact.

3. The receptacle connector as claimed in claim 1, wherein the front intermediate sections of the conductive contacts interferentially engage with inner walls of respective openings of the partition wall.

4. The receptacle connector as claimed in claim 1, wherein the insulative housing forms a plurality of latch arms bending from the mounting face toward the partition wall, and the retainer seat forms a plurality of bosses with inclined surfaces, and wherein the bosses latch with corresponding latch arms when the retainer seat is received in the mounting recess of the insulative housing.

5. The receptacle connector as claimed in claim 1, wherein the front intermediate section of each conductive contact forms a protruding peak in a rear section thereof, and wherein a front surface of the retainer seat is stopped by the protruding peak when a force separating the insulative housing from the conductive contacts is applied to the insulative housing.

6. The receptacle connector as claimed in claim 5, wherein the retainer seat defines a plurality of cutouts recessed inwardly from the front surface, a left side surface and a right side surface thereof.

7. The receptacle connector as claimed in claim 6, wherein the partition wall of the insulative housing defines a plurality of heat-radiating slots, and wherein the heat-radiating slots cooperate with the cutouts of the retainer seat to form channels of airflow.

8. A receptacle connector adapted for being mounted to a Printed Circuit Board (PCB) and mating with a plug connector, comprising:

an insulative housing comprising a mating face adapted for mating with the plug connector and a mounting face opposite to the mating face, the insulative housing defining a plurality of contact-receiving passages penetrating from the mating face to the mounting face and a mounting recess recessed from the mounting face toward the mating face a certain distance;

a plurality of conductive contacts respectively received in the contact-receiving passages, each conductive contact comprising a contacting portion adapted for electrically contacting the plug connector, a termination portion adapted for electrically connecting with the Printed Circuit Board, and an intermediate portion connecting the contacting portion with the termination portion; and a retainer seat fixedly received in the mounting recess of the insulative housing;

wherein the insulative housing forms a plurality of latch arms bending from the mounting face toward the partition wall, and the retainer seat forms a plurality of bosses with inclined surfaces, and wherein the bosses latch with corresponding latch arms when the retainer seat is received in the mounting recess of the insulative housing.

* * * * *